United States Patent [19]

Materkowski

[11] Patent Number: 5,066,546

[45] Date of Patent: Nov. 19, 1991

[54] WEAR-RESISTANT STEEL CASTINGS

[75] Inventor: James P. Materkowski, Latrobe, Pa.

[73] Assignee: Kennametal Inc., Latrobe, Pa.

[21] Appl. No.: 449,094

[22] Filed: Dec. 8, 1989

Related U.S. Application Data

[63] Continuation-in-part of Ser. No. 327,667, Mar. 23, 1989, abandoned.

[51] Int. Cl.[5] ..... B32B 15/04

[52] U.S. Cl. ..... 428/627; 428/683; 428/684

[58] Field of Search ..... 75/236, 241, 239, 240; 164/97; 428/553, 554, 558, 564, 556, 627, 683, 684, 681

[56] References Cited

U.S. PATENT DOCUMENTS

| | | | |
|---|---|---|---|
| 1,072,026 | 9/1913 | Morris | 164/97 |
| 1,310,528 | 7/1919 | Hadfield | 420/72 |
| 2,298,049 | 10/1942 | Gardner | 175/325 |
| 3,744,547 | 7/1973 | Panhard | 164/61 |
| 3,779,715 | 12/1973 | Wendler et al. | 29/182.1 |
| 4,024,902 | 5/1987 | Baum | 164/97 |
| 4,101,318 | 7/1978 | Rudy | 75/240 |
| 4,119,459 | 10/1978 | Ekemar et al. | 75/243 |
| 4,140,170 | 2/1979 | Baum | 164/493 |
| 4,146,080 | 3/1979 | Baum | 164/97 |
| 4,249,945 | 2/1981 | Haswell et al. | 75/241 |
| 4,584,020 | 4/1986 | Waldenström | 75/235 |
| 4,608,318 | 8/1986 | Makrides et al. | 428/553 |
| 4,612,067 | 9/1986 | Larson et al. | 148/329 |
| 4,715,450 | 12/1987 | Hallissy et al. | 172/701.3 |

FOREIGN PATENT DOCUMENTS

| | | | |
|---|---|---|---|
| 131362/77 | of 1979 | Australia . | |
| 81105783.5 | 7/1981 | European Pat. Off. . | |
| 3515975 | 12/1985 | Fed. Rep. of Germany | 164/97 |
| 0160564 | 10/1982 | Japan | 164/97 |
| 0124458 | 7/1985 | Japan | 164/97 |
| 0245958 | 11/1986 | Japan | 164/97 |

OTHER PUBLICATIONS

E. L. Furman et al, "Reinforcing Steel Castings with Wear-Resisting Cast Iron," Liteinoe Proizvodstvo, No. 7, p. 27 (1986).

Kennametal Inc. brochure, Kengard A.

Kura, J. G., "Cast Bonding Produces Quality Metallic Composites," Materials Engineering (1984), p. 60.

Hansen, J. S., "Cast-On Surfacing of Polystyrene Pattern Castings," American Foundry Men's Society, pub. Apr. 1983, pp. 65-70.

Gouin, C. E., "Manganese Steels That Don't Require Heat Treatment," Casting Eng., Summer 1976, pp. 27, 28, 30.

*Primary Examiner*—Brooks H. Hunt
*Assistant Examiner*—Ngoclan Mai
*Attorney, Agent, or Firm*—Larry R. Meenan

[57] ABSTRACT

A tough, wear resistant body is provided. The body includes hard carbide particles embedded in and bonded with a first casted ferrous matrix material such as steel or cast iron. The body may be embedded in and bonded with a second steel matrix to form a wear resistant composite. The second steel matrix has a melting point at least 200 degrees F. greater than the melting point of the first ferrous matrix, thereby facilitating a metallurgical bond between the surface of the wear resistant body and the second steel matrix. The composite structure is particularly suitable for earthmoving and other severe mechanical applications.

15 Claims, 1 Drawing Sheet

10
12
14
16
20
22
24
26
30

WEAR-RESISTANT STEEL CASTINGS

This is a continuation-in-part of copending application Ser. No. 07/327,667 filed on Mar. 23, 1989, now abandoned.

BACKGROUND OF THE INVENTION

1. Field of the Invention

The present invention generally relates to wear-resistant castings and their manufacture and, more particularly, to articles having particles of sintered or cast hard carbides disposed in a casted steel alloy matrix, and to composite structures formed therefrom.

2. Description of the Prior Art

Parts for use in severe environments must combine wear resistance with toughness. Applications for such parts include earth or road engaging wear shoes, excavator teeth, and crusher teeth.

Suitable wear-resistant materials have been made of cemented carbide alloys consisting of a finely dispersed hard carbide phase cemented together by cobalt or nickel or both. The materials are produced by compacting finely milled powders together followed by liquid phase sintering to achieve consolidation. Typically the cemented carbide alloys possess microstructures characterized by hard carbide grains generally in the range of 1–15 microns. However, such materials may be subject to chipping or cracking when utilized by themselves. For those applications, it is desirable to have the wear properties of carbide combined with the toughness of steel.

The use of a cast iron or steel matrix as a binding material has proven difficult because the finely divided state and high specific surface of the dispersed hard carbide phases and the formation of comparatively brittle binder alloys of tungsten and iron with carbon. This reduces the free binder volume fraction of the body, thereby embrittling the sintered body. Unlike cobalt and nickel, the iron component of cast iron or steel will form a stable carbide (Fe3C) and has a greater tendency to form brittle binary carbides than either the cobalt or nickel binder materials. In addition, carbon transfer from the hard carbide phase or phases to the iron component is promoted by the presence of the liquid or plastic state of the iron or steel binder during liquid phase sintering when carried out at temperatures near to or above the melting point of the binder. However, useful wear resistant bodies have been made by casting a steel or cast iron melt into a bed of comparatively coarse hard carbide particulate.

One such technique is set forth by the molten steel casting method of Charles S. Baum (U.S. Pat. Nos. 4,024,902 and 4,146,080). Unlike the prior art methods which had attempted to avoid the dissolution of the metallic carbide components into the matrixing alloy, Baum taught the placement of tungsten carbide particles of substantially larger size than those desired in the finished article in a mold in which the wear resistant body is to be formed.

According to Baum, a steel alloy is separately heated and casted into the mold which is at a temperature below the temperature at which the metallic carbide dissolves. The size and placement o the particles are balanced with the temperature of the molten steel, the initial temperature of the mold, and the volume and surface area of the mold to insure that the heat of the molten steel causes a dissolving action at the surface of the particles and at least some of the particles still exist in reduced size when the molten steel freezes. The fusion of the carbon, tungsten and cobalt through the alloy also produces an alloy having superior strength, including greater strength than the original casted alloy. In addition. the degree of solubility may be controlled by the inclusion of some smaller sintered particles that totally dissolve as the molten metal solidifies.

Another such wear resistant body is disclosed in U.S. Pat. No. 4,119,459 issued to Ekemar. Ekemar found that cemented carbide could be bonded in a matrix of graphitic cast iron having a carbon equivalent in the range of from 2.5 to 6.0 weight percent (wt. %). Ekemar also found that a suitable adjustment of the particle size of the hard carbide gave the possibility to reach the desired relationship between completely transforming or partially transforming the hard carbide particles.

It would be expected that the wear resistant bodies formed by the molten steel casting method may have superior physical properties over similar molten-cast iron bodies. For example, martensitic ductile cast iron can result in tensile strengths of up to 120 ksi, which is considered high for ductile iron. However, medium carbon steels may have tensile strengths of up to 220 ksi. Thus, a matrix of low alloy steel will have approximately twice the strength of a comparable cast iron product. Furthermore, the hardness of heat treated, low alloy steel casting would be between 40 and 50 $R_c$ versus 38 $R_c$ for ductile iron.

However, wear-resistant bodies produced by either the molten-steel or the molten-cast iron casting methods are often not suitable when used solely as a stand-alone product because their high cost and brittleness. Instead, the wear-resistant body may be more cost effective when used to increase the wear-performance of a larger steel casting in which it is incorporated.

It has been relatively easy to incorporate wear resistant bodies produced by the molten-cast iron method into larger steel castings. For example, U.S. Pat. No. 4,584,020, issued to Waldenstrom, discloses a technique for incorporating a wear resistant molten-cast iron and carbide insert in a larger steel casting. The technique consists of applying between the casted steel alloy and the wear resistant insert a layer or zone of another metallic material with a higher toughness than the cast alloy. Generally the metallic material also has a higher melting point than the cast alloy and preferably at least 200 to 400 degrees C. (360 degrees F. to 720 degrees F.) above the melting point of the cast alloy. The metallic material is formed from a low carbon steel having a carbon content of 0.2% at the most. The thickness of the sheet of low carbon steel is at least 0.5 mm and preferably 1 to 8 mm.

Unfortunately, problems have arisen when attempting to incorporate molten-steel wear resistant bodies in larger castings. Several approaches have been tried to overcome these problems. E. L. Furman et al ("Reinforcing Steel Castings With Wear-Resisting Cast Iron," Liteinoe Proizvodstvo, No. 7, p.27 (1986)) found that wear resistant bodies could be successfully incorporated into larger steel castings when the steel was poured at between 1450 to 1480 degrees C. (2642 to 2696 degrees F.). However, when the steel pouring temperature was raised above 1500 degrees C. (2732 degrees F.) it caused hot tearing and shrinkage blow holing inside the wear resistant inserts. Furman found that more effective reinforcement could be achieved by coating the inserts with a low melting brazing alloy, such as pure copper, prior to pouring the mold. Upon pouring, the copper brazing alloy melts and wets the surfaces of the inserts and the poured steel. A suitable fluxing agent was incorporated to prevent oxidation of the inserts during pouring.

U.S. Pat. No. 4,608,318, issued to Makrides et al discloses a tough, wear resistant composite. Carbide particles and a stainless steel metallic matrix are first formed into a wear-resistant insert by powder metallurgical methods including blending the powders, isostatically compacting the blend, and consolidating to form the insert. A second metallic matrix of molten metal is then bonded to the wear-resistant insert to complete the composite. The second metallic matrix formed by the molten metal may be a ferrous or non-ferrous alloy and is preferably steel.

Another powder metallurgical approach to this problem is disclosed in Australian Patent No. AU-B1-31362/77. According to the background discussion in U.S. Pat. No. 4,608,318, the Australian reference teaches milling a heat treatable low alloy steel powder together with a tungsten carbide or tungsten molybdenum solid solution carbide powder and then pressing and sintering to form the wear-resistant insert. Low alloy steel is then cast about the sintered wear-resistant insert to form the finished composite.

Certain disadvantages become apparent with the prior art. First, the technique as taught by Furman requires the additional step of coating the individual inserts. This method not only increases the cost of the final composite body but also creates an additional interface which may result in a later failure. Second, the powder metallurgical methods taught by Makrides and also Australian patent No. AU-B1-31362/77 are significantly more costly due to the necessary steps of preparing milled powders, blending, and isostatically pressing to form the insert.

It has thus become desirable to develop a wear-resistant cast "carbide/ferrous composite" insert having the strength and hardness advantages achieved by using a molten steel casting alloy or a molten cast iron and, at the same time, eliminating the prior art problems of hot tearing and shrinkage when the wear resistant body is incorporated into a larger steel casting.

SUMMARY OF THE INVENTION

The present invention solves the aforementioned problems associated with the prior art by providing an improved tough, wear-resistant cast "carbide ferrous matrix composite" insert formed by a molten ferrous casting process. The wear resistant body may be subsequently incorporated into a larger steel casting and which will form a strong, metallurgical bond with the steel matrix of the larger casting without hot tearing or shrinkage blow holing inside the inserts. The wear-resistant inserts are made by a casting process in which casted ferrous matrix material having a melting point of between 2100 and 2600 degrees F. is combined with particles or compacts of sintered tungsten carbide or similar hard carbides. The insert is then placed into a suitable mold into which steel of a melting point of between 2700 and 2800 degrees F. is poured. The casted steel metallurgically bonds to the insert to form a composite structure. The fusion is facilitated by the fact that the melting temperature of the ferrous matrix alloy used for preparing the wear-resistant insert is lower than the melting temperature of the casted steel. In addition, the use of a separate wear-resistant insert allows a variety of concentrations, positions, and orientations of the carbide particles both on the surface and beneath surface of the low alloy substrate, thereby allowing the physical properties of the composite to be tailored for specific applications.

Accordingly, one aspect of the present invention is to provide a tough, wear resistant body including a hard carbide material and a casted ferrous matrix material, wherein the carbide material is embedded in and bonded to the casted ferrous matrix.

Another aspect of the present invention is to provide a tough, wear resistant composite body including a hard carbide material and a first casted ferrous matrix material form into a wear resistant body and a second steel matrix, wherein the wear resistant body is embedded in and bonded to the second steel matrix.

Still another aspect of the present invention is to provide a method of forming a tough, wear resistant composite body including the steps of positioning a plurality of hard carbide particles within a first mold, separately melting a first ferrous matrix material and casting the first ferrous matrix into the mold to form a wear resistant body, positioning the wear resistant body within a second mold, and separately melting a second steel matrix and casting the second steel matrix into the second mold, wherein the wear resistant body is embedded in and bonded to the second steel matrix. The first ferrous matrix material may be either steel or cast iron.

These and other aspects of the present invention will become apparent to those skilled in the art after a reading of the following description of the preferred embodiment when considered with the drawings.

DESCRIPTION OF THE PREFERRED EMBODIMENT

Figures 1, 2, 3:
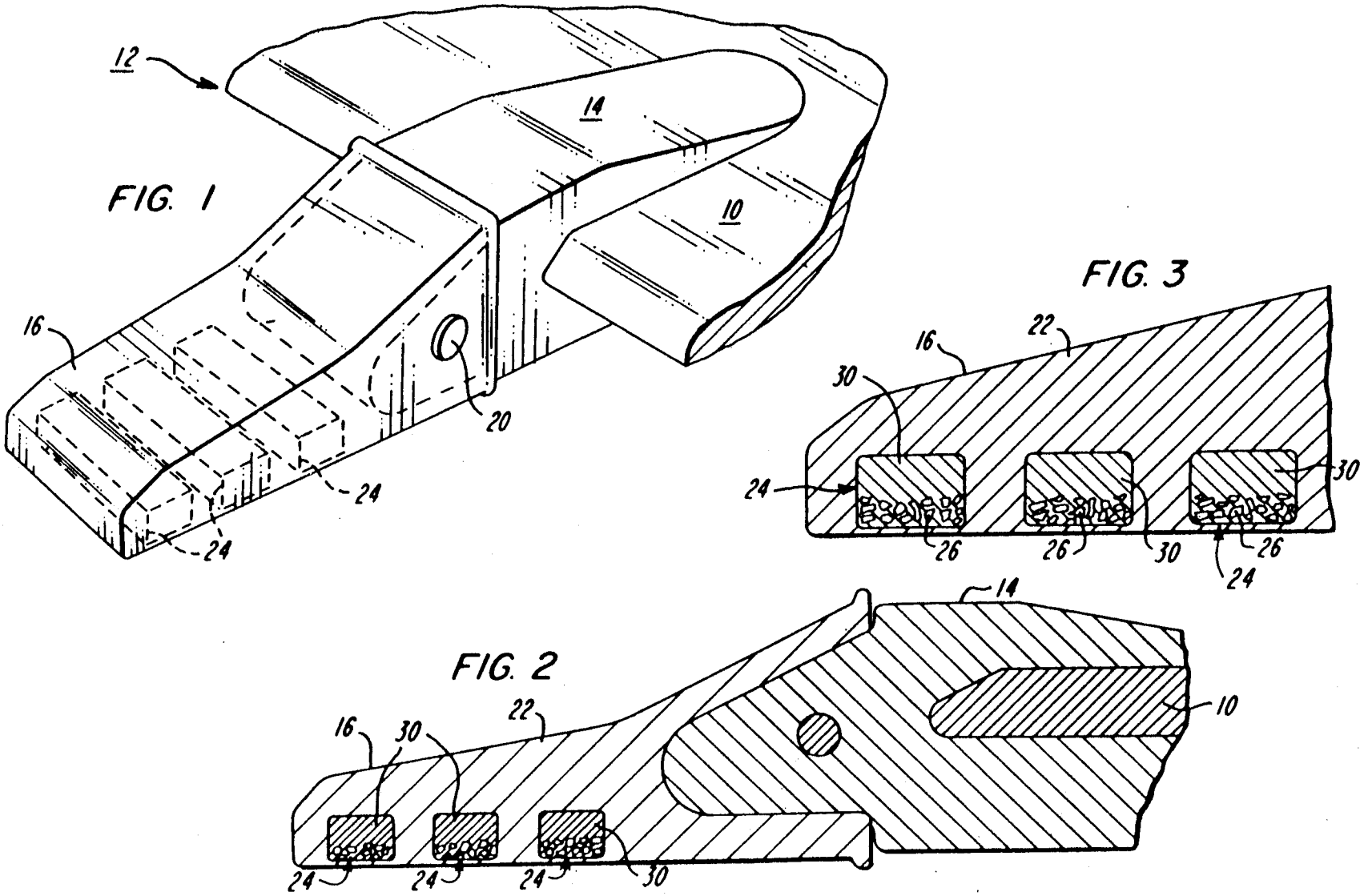
FIG. 1 is a fragmentary isometric view of an excavator bucket with an excavator tooth secured thereto constructed according to the present invention.
FIG. 2 is a vertical sectional view of the excavator tooth shown in FIG. 1, taken along line 2—2.
FIG. 3 is an enlarged cross-sectional view of the cast wear insert shown in FIG. 2.

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and to FIG. 1 in particular, it will be understood that the illustrations are for the purpose of describing a preferred embodiment of the invention and are not intended to limit the invention thereto. As best seen in FIG. 1, there is partially shown the lower lip 10 of a conventional excavator bucket 12 such as may be employed on a backhoe or front-end loader. A tooth support 14 is welded or otherwise attached to lip 10. Excavator tooth 16 is secured to tooth support 14 by any of a number of conventional attachment means 20, including bolts or pins. Excavator tooth 16 includes a recessed portion (see FIG. 2) for receiving the elongated portion of tooth support 14. The tooth support 14 is normally composed of a conventional, heat treatable medium carbon alloy steel such as AISI 4330 or commonly used modifications thereof.

Turning now to FIG. 2, a vertical sectional view of the excavator tooth 16 shown in FIG. 1 is illustrated. Excavator tooth 16 is a composite structure comprising a cast "low C" carbon alloy 22 and a cast steel "carbide/steel composite", or cast "carbide/cast iron composite" wear resistant insert 24. It is to be understood that in the following description "low C" refers to a carbon content of less than 1 wt. % and "high C" refers to a carbon content of at least 0.85 wt %. In addition, the term "carbon equivalent" is defined as equal to the sum of the carbon content wt. % plus 0.3 times the sum of the silicon and phosphorus wt. %. The "low C" substrate 22 may be composed of an air-hardening Ni-Cr-Mo or Si-Mn-Ni-Cr-Mo low alloy steel material having a melting point of about 2700 degrees F. but preferably is a typical heat treatable medium carbon alloy steel such as AISI 4330 and its common modifications which have been used in the prior art for tooth support 14. Preferably, the carbon content of the substrate composition is nominally 0.25% to 0.35% carbon. The cast alloy of substrate 22 typically has a heat treated hardness range of between 40 and 50 $R_c$.

Prior to pouring the "low C" substrate 22, the cast ferrous matrix wear resistant insert 24 is first positioned within a mold. Preheating of the cast ferrous matrix wear resistant insert 24 is not required prior to pouring of the molten metal into the mold. The pouring temperature of the cast alloy substrate 22 is about 2950 to 3050 degrees F. After pouring, the excavator tooth 16 is allowed to cool and then is shaken out of the mold and heat treated to the desired hardness.

Turning to FIG. 3, an enlarged cross-sectional view of the cast ferrous wear-resistant insert 24 is shown. Wear resistant insert 24 includes one or more layers of hard carbide particulate 26. The carbide particulate 26 is typically composed of irregularly shaped particles of from 4 mesh to ⅜ inch in size. However, particles of finer than 4 mesh or larger than ⅜ inch having either regular or irregular shapes may be used. The carbide particulate 26 is preferably a cobalt cemented tungsten carbide which may contain tantalum, titanium, and/or niobium. Other hard carbides may also be used and may be selected from the group consisting of tungsten carbide (eutectic cast tungsten carbide or macrocrystalline tungsten carbide), titanium carbide, tantalum carbide, niobium carbide, zirconium carbide, vanadium carbide, hafnium carbide, molybdenum carbide, chromium carbide, boron carbide, silicon carbide, their mixtures, solid solutions, and cemented composites.

The "high C" cast ferrous matrix material may be an alloy steel, such as an austenitic manganese alloy steel, a ferrite alloy steel or a cast iron. For example, an alloy steel having a melting point of about 2400 to 2600 degrees F. and, preferably, 1.0 to 2.5% carbon equivalent, is cast about the carbide particulate 26 and allowed to cool to form the matrix 30 of wear-resistant insert 24. In yet another example of the present invention, cast iron having a melting point of approximately 2100 to 2400 degrees F. may be cast about the carbide particulate 26 and allowed to cool to form the matrix 30 of wear-resistant insert 24. The casting procedure used may be any of those well-known to those skilled in the art. However, it is preferred that the casting procedure disclosed in detail in the Baum U.S. Pat. Nos. 4,024,902 and 4,146,080 be used. The entire disclosure of these patents are incorporated herein by reference.

As discussed above, after cooling, the wear-resistant insert 24 is placed inside a mold cavity (not shown) for the excavator tooth 16. The "low C" carbon content molten steel 22 is poured into the mold cavity which contains the insert 24. The "low C" molten steel 22 flows about and envelopes the insert 24 and a strong, metallurgical bond is achieved between the insert 24 and the poured steel 22. The metallurgical bond is facilitated by the fact that the melting point of "high C" matrix 30 of the wear-resistant insert 24 is considerably lower than that of the "low C" molten steel being poured, preferably at least 200 to 300 degrees F. lower. As a result, some melting will occur at the surface of insert 24. This molten surface layer fuses readily with the "low C" steel 22 being poured and a sound bond is obtained after solidification has taken place.

On the contrary, it has been shown that if the wear resistant inserts 24 are made with a "low C" carbon steel, bonding with the "low C" steel 22 being poured does not occur because the melting points of both materials are essentially the same and therefore the amounts of superheat is not sufficient to melt the first ferrous matrix. Thus, the wear-resistant insert 24 must have a melting point lower than that of the substrate 22, since the relative difference in melting points is a key factor responsible for achievement of a metallurgical bond between the insert 24 and the substrate 22.

The process and products according to the present invention will become more apparent upon reviewing the following detailed examples.

EXAMPLE NO. 1

A number of wear and impact resistant excavator teeth having a wear-resistant insert embedded therein were fabricated. A mixture of cobalt cemented tungsten carbide having 4 mesh to ⅜ inch particles were placed in a sand mold having multiple recesses corresponding roughly to the desired dimensions of the insert. For this particular application, the individual inserts were 1 inch by 4 inches and ¾ inches deep. The amount of carbide particulate chosen was such that at least one layer of carbide particles covered the bottom of each recess. A "high C" carbon content steel having about 1.8 wt. % C and a total carbon equivalent value of 2.4 was melted and cast at between 2850 and 2950 degrees F. about the tungsten carbide particulate. The nominal composition of the steel was 1.8% C, 2.0% Si, 0.5% Mn, 1% Mo, typical impurities, and the remainder Fe. The molds were preheated to between 1500 and 1800 degrees F. prior to casting. Upon cooling, the insert castings were removed from the sand mold and placed inside of a second sand mold having a recess formed to the required excavator tooth shape. The ingredients to produce a "low C" carbon content steel alloy were melted in a induction furnace, the molds were not preheated, and the "low C" steel was cast into the mold at between 3050 degrees to 3100 degrees F. to form the excavator tooth 16 shown in FIGS. 1 and 2. The nominal composition of the "low C" steel was 0.3% C, 1.5% Si, 1.0% Mn, 1.0% Ni, 2.0% Cr, 0.35% Mo, typical impurities, and the remainder Fe. The tooth was then heat treated by normalizing at about 1750 degrees F. for approximately 3 hours and then air cooled. The tooth was then austenitized at 1650 degrees F. for approximately 3 hours, water quenched, and tempered at 400 degrees F. for a minimum of 3 hours.

A visual examination disclosed that the higher melting point "low C" steel caused a portion of the surface of the wear-resistant insert, having a higher carbon equivalent matrix, to melt. The examination also indicated that the molten surface layer fused readily with the "low C" steel being poured and that a sound bond had been obtained.

Hardness measurements of a section of the cast excavator tooth showed hardness values in the range of 35 to 45 $R_c$ and 45 to 50 $R_c$ within a traverse of the "high C" steel matrix and the "low C" air-hardened steel, respectively.

EXAMPLE NO. 2

Another group of wear and impact resistant excavator teeth having a wear-resistant insert embedded therein were fabricated. A mixture of cobalt cemented tungsten carbide having 4 mesh to ⅜ inch particles were placed in a sand mold having multiple recesses corresponding to the dimensions of the insert. For this application, the individual inserts were again 1 inch by 4 inches and ¾ inches deep. The amount of carbide particulate chosen was such that at least one layer of carbide particles covered the bottom of each recess. A "low C", low alloy steel having a total carbon equivalent value of about 0.6 was melted and cast at about 3150 degrees F. about the tungsten carbide particulate. The nominal composition of the "low C" steel was 0.3% C, 1.0% Si, 0.5% Mn, 4.0% Ni, 1.4% Cr, 0.25% Mo, typical impurities, and the remainder Fe. The molds were preheated to between 1500 and 1800 degrees F. prior to casting. Upon cooling, the insert castings were removed from the sand mold and placed inside of a second sand mold having a recess formed to the required excavator tooth shape. The ingredients to produce the same "low C" steel alloy as used for the substrate 22 in Example No. 1 were melted in a induction furnace, the molds were not preheated, and the steel was cast into the mold at between 3050 degrees to 3100 degrees F. to form the excavator tooth 16 shown in FIGS. 1 and 2. No heat treatment was performed.

EXAMPLE NO. 3

A number of wear and impact resistant excavator teeth having a wear-resistant insert embedded therein were fabricated. A mixture of cobalt cemented tungsten carbide having 4 mesh to ⅜ inch particles were placed in a sand mold having multiple recesses corresponding roughly to the desired dimensions of the insert. For this particular application, the individual inserts were 2 inches by 4 inches and ¾ inches deep. The amount of carbide particulate chosen was such that at least one layer of carbide particles covered the bottom of each recess. A "high C" ferrous austenitic alloy having about 3.8 wt. % C and a total carbon equivalent value of 4.4 was melted in an induction furnace and cast at about 2700 degrees F. about the tungsten carbide particulate. The nominal composition of the ferrous alloy was 3.8% C, 1.9% Si, 0.2% Mn, 11.3% Ni and 1.5% W, typical impurities and the remainder Fe. The molds were preheated to between 1500 and 1800 degrees F. prior to casting. Upon cooling, the insert castings were removed from the sand mold and placed inside of a second sand mold having a recess formed to the required excavator tooth shape. The ingredients to produce a "low C" carbon content steel alloy were melted in an induction furnace, the molds were not preheated, and the "low C" steel was cast into the mold at 3025 degrees F. to form the excavator tooth 16 shown in FIGS. 1 and 2. The nominal composition of the "low C" steel was 0.3% C, 1.5% Si, 1.5% Mn, 1.5% Ni, 0.8% Cr, 0.3% Mo, typical impurities and the remainder Fe.

A visual examination disclosed that the higher melting point "low C" steel, being poured at 3025 degrees F., caused a portion of the surface of the wear-resistant insert, having higher carbon equivalent matrix, to melt. The melting point of the insert matrix alloy was estimated to be between about 2150 and 2250 degrees F. The examination also indicated that the molten surface layer fused readily with the "low C" steel being poured and that a sound bond had been obtained.

EXAMPLE 4

A number of wear and impact resistant excavator teeth having a wear-resistant insert embedded therein were fabricated. A mixture of cobalt cemented tungsten carbide having 4 mesh to ⅜ inch particles were placed in a sand mold having multiple recesses corresponding roughly to the desired dimensions of the insert. For this particular application, the individual inserts were 1 inch by 4 inches and ¾ inches deep. The amount of carbide particulate chosen was such that at least one layer of carbide particles covered the bottom of each recess. A "high C" ferrous alloy having about 3.1 wt. % C and a total carbon equivalent value of 3.6 was melted in an induction furnace and cast at approximately 2780 degrees F. about the tungsten carbide particulate. The nominal composition of the ferrous alloy was 3.1% C, 1.4% Si, 0.3% Mn, 1.7% Ni, 0.6% Cr, 3.6% W, typical impurities and the remainder Fe. The molds were preheated to between 1500 and 1800 degrees F. prior to casting. Upon cooling, the insert castings were removed from the sand mold and placed inside of a second sand mold having a recess formed to the required excavator tooth shape. The ingredients to produce a "low C" carbon content steel alloy were melted in an induction furnace, the molds were not preheated, and the "low C" steel was cast into the mold at approximately 3100 degrees F. to form the excavator tooth 16 shown in FIGS. 1 and 2. The nominal composition of the "low C" steel was 0.3% C, 1.5% Si, 1.5% Mn, 1.5% Ni, 0.8% Cr, 0.3% Mo, typical impurities and the remainder Fe.

A visual examination disclosed that the higher melting point "low C" steel, being poured at 3100 degrees F., caused a portion of the surface of the wear-resistant insert, having higher carbon equivalent matrix, to melt. The melting point of the insert matrix alloy was estimated to be between about 2250 and 2350 degrees F. The examination also indicated that the molten surface layer fused readily with the "low C" steel being poured and that a sound bond had been obtained.

One of the teeth was then heat treated by austenitizing at about 1750 degrees F. for approximately 3 hours followed by water quenching to room temperature, and tempering at about 400 degrees F. for approximately 4 hours. No evidence of cracking was observed in the wear-resistant inserts contained in the heat treated excavator tooth.

EXAMPLE 5

A steel casting of a rectangular bar shape incorporating wear-resistant austenitic manganese steel/carbide composite insert castings along one corner of the bar was produced. The cross-section of each individual insert castings was of a right-triangle, with dimensions of approximately 1¼ inches by 1¼ inches by 1¾ inches and of a length of approximately 3 inches.

The triangular bar shaped insert castings were made of a mixture of cobalt cemented tungsten carbide having 4 mesh to ⅜ inch particles positioned in a sand mold having multiple recesses corresponding roughly to the desired dimensions of the insert. The amount of carbide particulate chosen was such that at least one layer of carbide particles covered the bottom of the two 1¼ inch wide surfaces of the right triangle of each recess. An austenitic manganese steel alloy having approximately 0.9 wt % C and a carbon equivalent value of 1.2 was melted in an induction furnace and cast at 3050 degrees F. about the tungsten carbide particulate. The nominal composition of the austenitic manganese steel alloy was 0.9%, C, 13.5% Mn, 1.1% Si, 1.1% Mo, typical impurities and the remainder Fe. The mold containing the carbide particulate was preheated to between 1500 degrees F. and 1800 degrees F. prior to casting. Upon cooling, the composite insert castings were removed from the sand mold and placed inside of a second sand mold of a rectangular bar shape having a recess which measured 4½ inches by 7 inches by 3 inches. Two of the insert castings were placed in an end to end relationship along the 7 inch wide side of the bottom corner of the recess with the carbide containing surfaces of the composite insert castings facing outward against the sand. The ingredients to produce a "low C" steel were melted in an induction furnace. The mold was not preheated and the "low C" steel was cast into the mold at approximately 2950 degrees F. to form the composite casting. The nominal composition of the "low C" steel was 0.45% C, 0.75% Mn, 0.50% Si, 2.0% Cr, 0.45% Mo, typical impurities and the remainder Fe.

It will be appreciated that one possible application for the resultant wear resistant composite casting in the form of a rectangular block including a casted insert of the shape described above along the length of one corner of the block is in mineral crushing hammers.

A visual examination of a cross-section of the casting disclosed that the "low C" steel being poured at 2950 degrees F. caused a portion of the surface of the higher carbon equivalent insert matrix alloy (austenitic manganese steel) to melt. The melting point of the insert matrix alloy was estimated to be between 2500 and 2600 degrees F. The examination also indicated that a sound fusion bond had been obtained between the insert matrix alloy and "low C" steel which comprised the body of the casting.

A visual examination disclosed that the substantially equal melting points of "low C" and the low alloy steel did not cause the surface of the wear-resistant insert, having a substantially equal carbon equivalent matrix, to melt. The examination also indicated that a sound bond was not obtained.

Certain modifications and improvements will occur to those skilled in the art upon reading of the foregoing description. It should be understood that all such modifications and improvements have been deleted herein for the sake of conciseness and readability but are properly within the scope of the following claims.

What is claimed is:

1. A tough, wear resistant body comprising:
(a) at least one layer of a carbide material selected from the group consisting of tungsten carbide, titanium carbide, tantalum carbide, niobium carbide, zirconium carbide, vanadium carbide, hafnium carbide, molybdenum carbide, chromium carbide, boron carbide, silicon carbide, their mixtures, solid solutions, and cemented composites;
(b) a casted steel matrix material, wherein said carbide material is embedded in and bonded to said casted steel matrix; and
(c) wherein said steel matrix has a carbon equivalent value of between 1.5 and 2.5.

2. The wear resistant body according to claim 1, wherein said carbide material has an average particle size greater than 4 mesh.

3. The wear resistant body according to claim 2, wherein said carbide material has an average particle size between 4 mesh and ⅜ inch.

4. The wear resistant body according to claim 2, wherein said carbide material is in the form of crushed parts, powder or pressed bodies having an irregular shape.

5. The wear resistant body according to claim 1, wherein said steel matrix has a hardness value of between 35 and 45 $R_c$.

6. The wear resistant body according to claim 1, wherein said steel matrix has a melting point of between 2400 and 2600 degrees F.

7. The wear resistant body according to claim 1, wherein said steel matrix is more than 90% dense.

8. A tough, wear resistant composite body comprising:
(a) at least one layer of a carbide material selected from the group consisting of tungsten carbide, titanium carbide, tantalum carbide, niobium carbide, zirconium carbide, vanadium carbide, hafnium carbide, molybdenum carbide, chromium carbide, boron carbide, silicon carbide, their mixtures, solid solutions, and cemented composites;
(b) a first casted steel matrix material, wherein said carbide material is embedded in and bonded to said first casted steel matrix to form a wear resistant body; and
(c) a second steel matrix, having a melting point at least 200 degrees F. greater than the melting point of said first steel matrix, wherein said wear resistant body is embedded in and bonded to said second steel matrix.

9. The wear resistant composite according to claim 8, wherein said second steel matrix substantially surrounds said wear resistant body.

10. The wear resistant composite according to claim 8, wherein said carbide material is in the form of crushed parts, powder or pressed bodies having an irregular shape.

11. The wear resistant composite according to claim 8, wherein said second steel matrix is a low carbon steel having a carbon content of less than 1.0 wt. %.

12. The wear resistant composite according to claim 11, wherein said second steel matrix has a hardness value of between 40 and 50 $R_c$.

13. The wear resistant composite according to claim 11, wherein said low carbon second steel matrix has a melting point of between 2700 and 2800 degrees F.

14. The wear resistant composite according to claim 8, wherein said second steel matrix is more than 90% dense.

15. The wear resistant body according to claim 1, wherein said steel matrix is an austenitic manganese steel.

* * * * *